US009702031B2

(12) United States Patent
Akamatsu et al.

(10) Patent No.: US 9,702,031 B2
(45) Date of Patent: Jul. 11, 2017

(54) BAKE-HARDENABLE HIGH-STRENGTH COLD-ROLLED STEEL SHEET AND METHOD OF MANUFACTURING THE SAME

(75) Inventors: Satoshi Akamatsu, Tokyo (JP); Masaharu Oka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/989,271

(22) PCT Filed: Apr. 27, 2011

(86) PCT No.: PCT/JP2011/060273
§ 371 (c)(1),
(2), (4) Date: May 23, 2013

(87) PCT Pub. No.: WO2012/073538
PCT Pub. Date: Jun. 7, 2012

(65) Prior Publication Data

US 2013/0240094 A1 Sep. 19, 2013

(30) Foreign Application Priority Data

Nov. 29, 2010 (JP) ..... 2010-264447

(51) Int. Cl.
*C22C 38/54* (2006.01)
*C21D 8/04* (2006.01)
(Continued)

(52) U.S. Cl.
CPC ..... *C22C 38/54* (2013.01); *C21D 8/0263* (2013.01); *C21D 8/0436* (2013.01);
(Continued)

(58) Field of Classification Search
CPC ..... C22C 38/00; C22C 38/02; C22C 38/04; C22C 38/06; C22C 38/14; C22C 38/16;
(Continued)

(56) References Cited

U.S. PATENT DOCUMENTS 5,486,241 A * 1/1996 Ushioda et al. ..... 148/330
6,113,710 A * 9/2000 Kato ..... C21D 8/0405 148/325
(Continued)

FOREIGN PATENT DOCUMENTS

CN 1833042 A 9/2006
JP 7-188856 A 7/1995
(Continued)

OTHER PUBLICATIONS

NPL-1: Guo et al, Modelling phase transformation and material properties critical to the prediction of distortion during the heat treatment of steels, Int. J. Microstructure and materials properties, vol. 4, No. 2 2009 pp. 187-195.*
(Continued)

*Primary Examiner* — Jie Yang
(74) *Attorney, Agent, or Firm* — Birch, Stewart, Kolasch & Birch, LLP

(57) ABSTRACT

The present invention provides a bake-hardenable high-strength cold-rolled steel sheet having excellent bake hardenability, cold aging resistance, and deep-drawability, and reduced planar anisotropy, containing chemical components in % by mass of: C: 0.0010% to 0.0040%, Si: 0.005% to 0.05%, Mn: 0.1% to 0.8%, P: 0.01% to 0.07%, S: 0.001% to 0.01%, Al: 0.01% to 0.08%, N: 0.0010% to 0.0050%, Nb: 0.002% to 0.020%, and Mo: 0.005% to 0.050%, a value of [Mn %]/[P %] being in the range of 1.6 to 45, where [Mn %] is an amount of Mn and [P %] is an amount of P, an amount of C in solid solution obtained from [C %]−(12/93)×[Nb %] being in the range of 0.0005% to 0.0025%, where [C %] is an amount of C and [Nb %] is an amount of Nb, with a balance including Fe and inevitable impurities, wherein the bake-hardenable high-strength cold-rolled steel sheet satisfies the following Equation (1), where X(222), X(110), and X(200) represent ratios of integrated intensity of X-ray
(Continued)

diffraction of {222} plane, {110} plane, and {200} plane, respectively, being parallel to a plane located at a depth of ¼ plate thickness measured from the surface of the steel sheet, and the bake-hardenable high-strength cold-rolled steel sheet has tensile strength in the range of 300 MPa to 450 MPa.

6 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C21D 8/02*** | (2006.01) |
| ***C22C 38/14*** | (2006.01) |
| ***C22C 38/16*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/52*** | (2006.01) |
| *C21D 9/48* | (2006.01) |

(52) U.S. Cl.
CPC ..... *C21D 8/0468* (2013.01); *C21D 8/0473* (2013.01); *C21D 9/46* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/42* (2013.01); *C22C 38/44* (2013.01); *C22C 38/48* (2013.01); *C22C 38/50* (2013.01); *C22C 38/52* (2013.01); *C21D 9/48* (2013.01); *C21D 2201/02* (2013.01); *C21D 2201/05* (2013.01)

(58) Field of Classification Search
CPC ..... C22C 38/44; C22C 38/48; C22C 38/50; C22C 38/52; C22C 38/54
USPC ..... 148/505, 330, 331, 332, 334, 336
See application file for complete search history.

(56) References Cited

U.S. PATENT DOCUMENTS

| | | | | |
|---|---|---|---|---|
| 6,217,675 | B1 * | 4/2001 | Taniguchi et al. | 148/328 |
| 7,559,997 | B2 * | 7/2009 | Nakajima et al. | 148/320 |
| 8,388,770 | B2 * | 3/2013 | Mineji | B21B 1/22 148/330 |

FOREIGN PATENT DOCUMENTS

| | | | |
|---|---|---|---|
| JP | 10-130733 | A | 5/1998 |
| JP | 2000-17386 | A | 1/2000 |
| JP | 2002-12920 | A | 1/2002 |
| JP | 2007-530783 | A | 11/2007 |
| JP | 4042560 | B2 | 2/2008 |
| JP | 2009-509046 | A | 3/2009 |
| KR | 10-2001-0023455 | A | 3/2001 |
| KR | 10-0685037 | B1 | 2/2007 |
| WO | WO 9214854 | A1 * | 9/1992 |
| WO | WO 2006/001583 | A1 | 1/2006 |
| WO | WO 2007/035059 | A1 | 3/2007 |

OTHER PUBLICATIONS

Korean Notice of Allowance and English translation, dated Oct. 6, 2013, for Patent Application No. 10-2013-7013283.
Taiwanese Office Action and English translation, dated Oct. 28, 2013, for Patent Application No. 100114829.
International Search Report, mailed Aug. 2, 2011, issued in PCT/JP2011/060273.

* cited by examiner

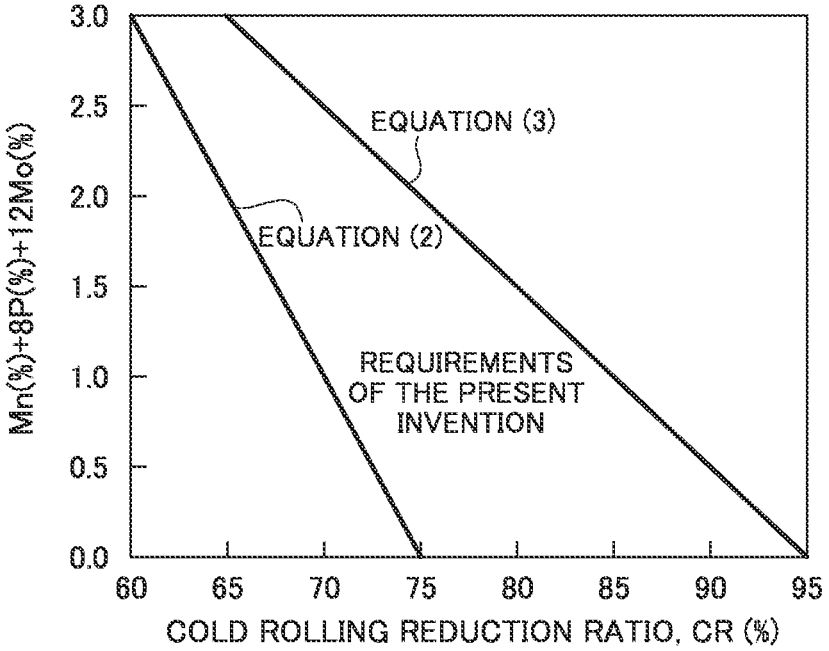
3.0
2.5
2.0
1.5
1.0
0.5
0.0
Mn(%)+8P(%)+12Mo(%)
EQUATION (3)
EQUATION (2)
REQUIREMENTS
OF THE PRESENT
INVENTION
60
65
70
75
80
85
90
95
COLD ROLLING REDUCTION RATIO, CR (%)

BAKE-HARDENABLE HIGH-STRENGTH COLD-ROLLED STEEL SHEET AND METHOD OF MANUFACTURING THE SAME

TECHNICAL FIELD

The present invention relates to a bake-hardenable high-strength cold-rolled steel sheet used for automobile outside panels, having tensile strength in the range of 300 MPa to 450 MPa, having excellent bake-hardenability (BH property), cold aging resistance and deep-drawability, and exhibiting reduced planar anisotropy, and to a method of manufacturing the bake-hardenable high-strength cold-rolled steel sheet.

The present application claims priority based on Japanese Patent Application No. 2010-264447 filed in Japan on Nov. 29, 2010, the disclosures of which are incorporated herein by reference.

BACKGROUND ART

High-strength steel sheets have been used for vehicle bodies for the purpose of reducing the weight of the vehicle. In recent years, these high-strength steel sheets have been required to have both reduced thickness and high dent resistance. To respond to these requirements, bake-hardenable cold-rolled steel sheets have been used.

The bake-hardenable cold-rolled steel sheets have yield strength close to that of a soft steel sheet, and hence, exhibit excellent formability at the time of press forming. Further, a coating and baking process is applied after the press forming to enhance the yield strength. More specifically, the bake-hardenable cold-rolled steel sheets have both high formability and high strength.

The baked hardening utilizes a sort of strain aging in which dislocation occurring during deformation is fixed by carbon in solid solution or nitrogen in solid solution, which are interstitial elements solid solved in steel. The amount of baked hardening (BH amount) increases with the increase in the the amounts of carbon in solid solution and the nitrogen in solid solution. However, if the solid-solution element excessively increases, the formability deteriorates due to the cold aging. Thus, it is important to appropriately control the solid-solution elements.

Conventionally, for the bake-hardenable cold-rolled steel sheet, attention has not been paid to the change in the r value (Lankford value) serving as an index for deep-drawability or the $|\Delta r|$ value indicating the planar anisotropy of the deep-drawability depending on the Mn and P added for enhancing the strength of the steel, or on the Mo added for increasing the cold aging resistance.

Conventionally, various bake-hardenable cold-rolled steel sheets have been proposed. For example, Patent Document 1 and Patent Document 2 describe a bake-hardenable high-strength cold-rolled steel sheet and a method of manufacturing the bake-hardenable high-strength cold-rolled steel sheet, in which solid solution strengthening of an ultralow carbon steel having Nb added therein is achieved by adding Mn and P; the bake hardenability is imparted by adjusting the amount of C in solid solution while taking the balance between the amount of C and the amount of Nb into consideration; and the cold aging resistance is imparted by adding Mo. However, the above techniques are made on the basis of the idea of utilizing the grain boundary carbon to obtain the bake hardenability by making the microstructure finer, and hence, AlN dispersion is essential. This inhibits the growth of the grain during annealing as well as the recrystallization. Further, in the first place, the amount of Al added is large, and hence, the surface defects caused by oxide are likely to occur. Yet further, these documents do not discuss the deep-drawability such as the r value and the planar anisotropy of the deep-drawability.

Patent Document 3 relates to a bake-hardenable high-strength cold-rolled steel sheet used for automobile outer panels and having cold aging resistance and a method of manufacturing the bake-hardenable high-strength cold-rolled steel sheet, in which a cold rolling reduction ratio is defined with a function of the amount of C added to reduce the planar anisotropy. However, rather than the ultralow carbon steel, Patent Document 3 relates to a steel sheet having a composite microstructure such as DP steel formed by ferrite and low-temperature transformation phase, and seems to relate to a steel having a significantly high strength. Further, the reason for adding Mo as well as Cr and V is to enhance the hardenability of austenite so as to obtain the low-temperature transformation phase. This document does not disclose the r value itself, and the deep-drawability is unclear.

RELATED ART DOCUMENTS

Patent Documents

Patent Document 1: Published Japanese Translation No. 2009-509046 of the PCT International Publication Patent Document 2: Published Japanese Translation No. 2007-089437 of the PCT international Publication Patent Document 3: Japanese Patent Publication No. 4042560

DISCLOSURE OF THE INVENTION

Problems to be Solved by the Invention

The present invention aims to solve problems of the conventional techniques described above, and to provide a bake-hardenable high-strength cold-rolled steel sheet having tensile strength in the range of 300 MPa to 450 MPa, having excellent bake-hardenability (BH property), cold aging resistance, and deep-drawability, and exhibiting reduced planar anisotropy, and a method of manufacturing the bake-hardenable high-strength cold-rolled steel sheet.

Means for Solving the Problems

In order to solve the problems described above, the present invention employs the following configurations and method.

(1) A first aspect of the present invention provides a bake-hardenable high-strength cold-rolled steel sheet having excellent bake hardenability, cold aging resistance, and deep-drawability, and reduced planar anisotropy, containing chemical components in % by mass of: C: 0.0010% to 0.0040%, Si: 0.005% to 0.05%, Mn: 0.1% to 0.8%, P: 0.01% to 0.07%, S: 0.001% to 0.01%, Al: 0.01% to 0.08%, N: 0.0010% to 0.0050%, Nb: 0.002% to 0.020%, and Mo: 0.005% to 0.050%, a value of [Mn %]/[P %] being in the range of 1.6 to 45, where [Mn %] is an amount of Mn and [P %] is an amount of P, an amount of C in solid solution obtained from [C %]−(12/93)×[Nb %] being in the range of 0.0005% to 0.0025%, where [C %] is an amount of C and [Nb %] is an amount of Nb, with a balance including Fe and inevitable impurities, wherein the bake-hardenable high-strength cold-rolled steel sheet satisfies the following Equation (1), where X(222), X(110), and X(200) represent ratios of integrated intensity of X-ray diffraction of {222} plane, {110} plane, and {200} plane, respectively, being parallel to a plane located at a depth of ¼ plate thickness measured from the surface of the steel sheet, and the bake-hardenable high-strength cold-rolled steel sheet has tensile strength in the range of 300 MPa to 450 MPa.

$$X(222)/\{X(110)+X(200)\}\geq 3.0 \quad \text{Equation (1)}$$

(2) The bake-hardenable high-strength cold-rolled steel sheet according to (1) above may further contain, by mass, at least one chemical component selected from: Cu: 0.01% to 1.00%, Ni: 0.01% to 1.00%, Cr: 0.01% to 1.00%, Sn: 0.001% to 0.100%, V: 0.02% to 0.50%, W: 0.05% to 1.00%, Ca: 0.0005% to 0.0100%, Mg: 0.0005% to 0.0100%, Zr: 0.0010% to 0.0500%, and REM: 0.0010% to 0.0500%.

(3) The bake-hardenable high-strength cold-rolled steel sheet according to (1) or (2) above may have a coated layer provided on at least one surface.

(4) A second aspect of the present invention provides a bake-hardenable high-strength cold-rolled steel sheet having excellent bake hardenability, cold aging resistance, and deep-drawability, and reduced planar anisotropy, containing chemical components in % by mass of: C: 0.0010% to 0.0040%, Si: 0.005% to 0.05%, Mn: 0.1% to 0.8%, P: 0.01% to 0.07%, S: 0.001% to 0.01%, Al: 0.01% to 0.08%, N: 0.0010% to 0.0050%, Nb: 0.002% to 0.020%, Mo: 0.005% to 0.050%, Ti: 0.0003% to 0.0200%, and B: 0.0001% to 0.0010%, a value of [Mn %]/[P %] being in the range of 1.6 to 45, where [Mn %] is an amount of Mn and [P %] is an amount of P, a value of [Nb %]/[Ti %] being in the range of 0.2 to 40, where [Nb %] is an amount of Nb and [Ti %] is an amount of Ti, a value of [B %]/[N %] being in the range of 0.05 to 3, where [B %] is an amount of B and [N %] is an amount of N, C in solid solution indicated by [C %]−(12/93)×[Nb %]−(12/48)×[Ti'%] being in the range of 0.0005% to 0.0025%, the [Ti'%] being [Ti %]−(48/14)×[N %] in the case of [Ti %]−(48/14)×[N %]≥0 whereas the [Ti'%] being zero in the case of [Ti %]−(48/14)×[N %]<zero, with a balance including Fe and inevitable impurities, wherein the bake-hardenable high-strength cold-rolled steel sheet satisfies the following Equation (1), where X(222), X(110), and X(200) represent ratios of integrated intensity of X-ray diffraction of {222} plane, {110} plane, and {200} plane, respectively, being parallel to a plane located at a depth of ¼ plate thickness measured from the surface of the steel sheet, and the bake-hardenable high-strength cold-rolled steel sheet has tensile strength in the range of 300 MPa to 450 MPa.

$$X(222)/\{X(110)+X(200)\}\geq 3.0 \quad \text{Equation (1)}$$

(5) The bake-hardenable high-strength cold-rolled steel sheet according to (4) above may further contain, by mass, at least one chemical component selected from: Cu: 0.01% to 1.00%, Ni: 0.01% to 1.00%, Cr: 0.01% to 1.00%, Sn: 0.001% to 0.100%, V: 0.02% to 0.50%, W: 0.05% to 1.00%, Ca: 0.0005% to 0.0100%, Mg: 0.0005% to 0.0100%, Zr: 0.0010% to 0.0500%, and REM: 0.0010% to 0.0500%.

(6) The bake-hardenable high-strength cold-rolled steel sheet according to (4) or (5) may have a coated layer provided on at least one surface.

(7) A third aspect of the present invention provides a method of manufacturing a bake-hardenable high-strength cold-rolled steel sheet, including: hot rolling a slab containing chemical components according to any one of (1), (2), (4) and (5) above at a heating temperature of not less than 1200° C. and at a finishing temperature of not less than 900° C. to obtain a hot rolled steel sheet; coiling the hot rolled steel sheet at a temperature in the range of 700° C. to 800° C.; cooling the hot rolled steel sheet that has been coiled at a cooling rate of not more than 0.01° C./sec so as to decrease the temperature at least from 400° C. to 250° C.; performing cold rolling under a condition that a cold rolling reduction ratio CR % at the time of cold rolling after acid pickling satisfies the following Equations (2) and (3), where [Mn %] is an amount of Mn, [P %] is an amount of P, and [Mo %] is an amount of Mo; performing continuous annealing in a temperature range of 770° C. to 820° C.; and performing temper rolling in a rolling reduction ratio of 1.0% to 1.5%.

$$CR\ \%\geq 75-5\times([Mn\ \%]+8[P\ \%]+12[Mo\ \%]) \quad \text{Equation (2)}$$

$$CR\ \%\leq 95-10\times([Mn\ \%]+8[P\ \%]+12[Mo\ \%]) \quad \text{Equation (3)}$$

(8) The method of manufacturing the bake-hardenable high-strength cold-rolled steel sheet according to (7) above may further include providing a coated layer on at least one surface before performing the temper rolling.

Effects of the Invention

According to the above-described configuration and method, the effect of adding Mn, P and other element is specified, and the cold rolling reduction ratio having a large effect on the deep-drawability is adjusted, whereby it is possible to provide a bake-hardenable high-strength cold-rolled steel sheet having tensile strength in the range of 300 MPa to 450 MPa, having excellent bake hardenability (BH property), cold aging resistance, and deep-drawability, and exhibiting reduced planar anisotropy.

BRIEF DESCRIPTION OF THE DRAWINGS

FIG. 1 is a diagram showing a relationship between a cold rolling reduction ratio CR % and components of a steel sheet according to an embodiment of the present invention.

EMBODIMENTS OF THE INVENTION

The present inventors made study on components of a steel sheet and a method of manufacturing the steel sheet, and found that, by applying cold rolling at a predetermined cold rolling reduction ratio while appropriately controlling chemical components of the steel sheet, it is possible to obtain a bake-hardenable high-strength cold-rolled steel sheet having tensile strength in the range of 300 MPa and 450 MPa, exhibiting excellent bake hardenability (BH property), cold aging resistance, and deep-drawability, and having reduced planar anisotropy.

Hereinbelow, a detailed description will be made of a bake-hardenable high-strength cold-rolled steel sheet based on the above-described findings and according to an embodiment of the present invention.

First, the chemical components of the bake-hardenable high-strength cold-rolled steel sheet according to this embodiment will be described. The amount of each chemical component is indicated in % by mass.

(C: 0.0010% to 0.0040%)

C is an element for facilitating solid solution strengthening and improving bake hardenability. In the case where the amount of C is less than 0.0010%, the tensile strength is undesirably low because of the significantly small amount of C, and the absolute amount of carbon existing in the steel is undesirably low even if Nb is added with the aim of making the crystal grain finer. Thus, the sufficient bake hardenability cannot be obtained. On the other hand, in the case where the amount of C exceeds 0.0040%, the amount of C in the solid solution state in the steel increases, and the bake hardenability significantly increases. However, the cold aging resistance of YP-El≤0.3% after aging cannot be obtained, and the stretcher strain occurs at the time of press forming, thereby deteriorating the formability. Thus, the amount of C is set to be in the range of 0.0010% to 0.0040%, and further, the amount of C in the solid solution is set to be in the range of 0.0005% to 0.0025% as described above, so that it is possible to obtain the bake hardenability with the BH amount of 30 MPa or more, and the cold aging resistance with YP-El of 0.3% or less after aging.

The lower limit of the amount of C is preferably set to be 0.0012%, and is more preferably set to be 0.0014%. The upper limit of the amount of C is preferably set to be 0.0038%, and is more preferably set to be 0.0035%.

(Si: 0.005% to 0.05%)

Si is an element for enhancing the strength. As the amount Si increases, the strength increases but the formability deteriorates. Thus, it is advantageous to minimize the amount of Si as much as possible, and hence, the upper limit of the amount of Si is set to be 0.05%. On the other hand, the lower limit of the amount of Si is set to be 0.005%, considering the cost required to reduce the amount of Si.

The lower limit of the amount of Si is preferably set to be 0.01%, and is more preferably set to be 0.02%. The upper limit of the amount of Si is preferably set to be 0.04%, and is more preferably set to be 0.03%.

(Mn: 0.1% to 0.8%)

Mn is an element functioning as a solid solution strengthening element for obtaining the tensile strength in the range of 300 MPa to 450 MPa. In the case where the amount of Mn is less than 0.1%, the appropriate tensile strength cannot be obtained. On the other hand, in the case where the amount of Mn exceeds 0.8%, the strength drastically increases and the formability deteriorates due to the solid solution strengthening. Thus, the amount of Mn is set to be in the range of 0.1% to 0.8%.

The lower limit of the amount of Mn is preferably set to be 0.12%, and is more preferably set to be 0.24%. The upper limit of the amount of Mn is preferably set to be 0.60%, and is more preferably set to be 0.45%.

(P: 0.01% to 0.07%)

As is the case with Mn, P is an element functioning as a solid solution strengthening element for obtaining the tensile strength in the range of 300 MPa to 450 MPa. In the case where the amount of P is less than 0.01%, the appropriate tensile strength cannot be obtained. On the other hand, in the case where the amount of P exceeds 0.07%, the brittleness in secondary working occurs. Thus, the amount of P is set to be in the range of 0.01 to 0.07%.

The lower limit of the amount of P is preferably set to be 0.011%, and is more preferably set to be 0.018%. The upper limit of the amount of P is preferably set to be 0.058%, and is more preferably set to be 0.050%.

Both Mn and P are the solid solution strengthening elements. If the ratio (Mn/P) of the amount of Mn relative to the amount of P is less than 1.6 or exceeds 45.0, the formability deteriorates. Thus, in the bake-hardenable high-strength cold-rolled steel sheet according to this embodiment, the amount of Mn and the amount of P are controlled such that the value of [Mn %]/[P %] falls in the range of 1.6 to 45.0, where [Mn %] is the amount of Mn and [P %] is the amount of P. With this control, it is possible to obtain the tensile strength in the range of 300 MPa to 450 MPa without deteriorating the formability.

The lower limit value of [Mn %]/[P %] is preferably set to be 4.0, and more preferably set to be 8.0. The upper limit value of [Mn %]/[P %] is preferably set to be 40.0, and is more preferably set to be 35.0.

(S: 0.001% to 0.01%)

In the case where the amount of S is large, the material deteriorates because of the excessive precipitation. Thus, the amount of S is set to be 0.01% or less. However, considering the cost required to reduce the amount of S, the lower limit of the amount of S is set to be 0.001%.

The lower limit of the amount of S is preferably set to be 0.002%, and is more preferably set to be 0.003%. The upper limit of the amount of S is preferably set to be 0.007%, and is more preferably set to be 0.006%.

(Al: 0.01% to 0.08%)

In general, 0.01% or more of Al is added to the steel for deoxidation. In the case where the amount of Al exceeds 0.08%, the surface defects resulting from oxide are likely to occur. Thus, the amount of Al is set to be in the range of 0.01% to 0.08%.

The lower limit of the amount of Al is preferably set to be 0.019%, and is more preferably set to be 0.028%. The upper limit of the amount of Al is preferably set to be 0.067%, and is more preferably set to be 0.054%.

(N: 0.0010% to 0.0050%)

N exists in the steel as nitrogen in solid solution to enhance the yield strength, and has extremely high diffusion rate as compared with that of carbon. Thus, in the case where N exists in the steel in the solid solution state, the cold aging resistance significantly deteriorates as compared with the case of carbon in solid solution. For this reason, N is set in the range of 0.0010% to 0.0050%.

The lower limit of the amount of N is preferably set to be 0.0013%, and is more preferably set to be 0.0018%. The upper limit of the amount of N is preferably set to be 0.0041%, and is more preferably set to be 0.0033%.

(Nb: 0.002% to 0.020%)

Nb is an element that strongly forms carbonitride to fix carbon existing in the steel as NbC precipitate, and functions to control the amount of carbon in solid solution in the steel. In order to obtain both the bake hardenability and the aging resistance with carbon in solid solution by maintaining the carbon in solid solution existing in the steel, the amount of Nb is set to be in the range of 0.002% to 0.020%, and C in solid solution is set to be in the range of 0.0005% to 0.0025% as described later. These settings provide the bake hardenability with the BH amount of 30 MPa or more, and the cold aging resistance with YP-El of 0.3% or less after aging.

The lower limit of the amount of Nb is preferably set to be 0.003%, and is more preferably set to be 0.005%. The upper limit of the amount of Nb is preferably set to be 0.012%, and is more preferably set to be 0.008%.

(Mo: 0.005% to 0.050%)

Mo existing in the solid solution state enhances the bonding force of the grain boundary to prevent the grain boundary from breaking due to P, in other words, improve the resistance to brittleness in secondary working, and suppresses the dispersion of carbon due to affinity with carbon in solid solution to improve the aging resistance, thereby contributing to the cold aging resistance with YP-El of 0.3% or less after aging. Thus, the lower limit of the amount of Mo is set to be 0.005%. On the other hand, the upper limit of the amount of Mo is set to be 0.050% by taking the manufacturing cost and the ratio of the amount relative to the effect obtained from the added amount of Mo into consideration.

The lower limit of the amount of Mo is preferably set to be 0.006%, and is more preferably set to be 0.012%. The upper limit of the amount of Mo is preferably set to be 0.048%, and is more preferably set to be 0.039%.

The rest of the steel is formed by Fe and other inevitable impurities. The steel may contain inevitable impurities to the extent that they do not interfere with the effect of the present invention but the inevitable impurities are desired to be minimized as much as possible.

(C in Solid Solution: 0.0005% to 0.0025%)

The bake-hardenable high-strength cold-rolled steel sheet according to this embodiment contains C in solid solution in the range of 0.0005% to 0.0025%. The lower limit of the amount of C in solid solution is preferably set to be 0.0006%, and is more preferably set to be 0.0007%. The upper limit of C in solid solution is preferably set to be 0.0020%, and is more preferably set to be 0.0015%. In the case where the bake-hardenable high-strength cold-rolled steel sheet according to this embodiment contains the above-described components, C in solid solution can be obtained from [C %]−(12/93)×[Nb %]. In this specification, [C %] and [Nb %] represent the amount of C and the amount of Nb, respectively.

With the bake-hardenable high-strength cold-rolled steel sheet according to this embodiment and having the above-described components, it is possible to obtain the tensile strength in the range of 300 MPa to 450 MPa, the excellent deep-drawability with the average r value≥1.4, the reduced planar anisotropy of $|\Delta r|\leq 0.5$, the bake hardenability with 30 MPa or more, and the cold aging resistance with YP-El≤0.3% after aging.

It should be noted that, in the bake-hardenable high-strength cold-rolled steel sheet according to this embodiment, the following chemical components may be added depending on application.

(Ti: 0.0003% to 0.0200%)

Ti is an element that complements Nb, and the steel may contain Ti in the range of 0.0003% to 0.0200% for the same reason as Nb.

In the case where Nb and Ti are added in a combined manner, C in solid solution can be obtained from [C %]−(12/93)×[Nb %]−(12/48)×[Ti'%]. In this specification, [C %] and [Nb %] represent the amount of C and the amount of Nb, respectively. In the case of [Ti %]−(48/14)×[N %]≥0, [Ti'%] is [Ti %]−(48/14)×[N %]. In the case of [Ti %]−(48/14)×[N %]≤0, [Ti'%] is zero.

In this case, the amount of C in solid solution may be in the range of 0.0005% to 0.0025%.

The lower limit of the amount of Ti is preferably set to be 0.0005%, and more preferably set to be 0.0020%. The upper limit of the amount of Ti is preferably set to be 0.0150%, and is more preferably set to be 0.0100%.

Both Nb and Ti described above are used for controlling the amount of C in solid solution. However, due to the difference in ability to form carbonitride, the amount of Nb and the amount of Ti may be controlled such that the value of [Nb %]/[Ti %] falls in the range of 0.2 to 40, where [Nb %] is the amount of Nb and [Ti %] is the amount of Ti, in order to further appropriately control the amount of C in a solid solution. The lower limit value of [Nb %]/[Ti %] is preferably set to be 0.3, and is more preferably set to be 0.4. The upper limit value of [Nb %]/[Ti %] is preferably set to be 36.0, and is more preferably set to be 10.0.

(B: 0.0001% to 0.0010%)

B is segregated in grain boundary, and is added to prevent the brittleness in secondary working. However, in the case where a certain amount or more of B is added to the steel, the material deteriorates in a manner such that the strength increases and the ductility is significantly reduced. Thus, B is required to be added to the steel in the appropriate range, and is preferable to be added to the steel in the range of 0.0001% to 0.0010%.

The lower limit of the amount of B is preferably set to be 0.0002%, and is more preferably set to be 0.0003%. The upper limit of the amount of B is preferably set to be 0.0008%, and is more preferably set to be 0.0006%.

Both B and N described above form BN, and in some cases, reduce the effect of strengthening the grain boundary with solute B. In order to suppress the reduction, the amount of B and the amount of N may be controlled such that [B %]/[N %] falls within the range of 0.05 to 3, where [B %] represents the amount of B and [N %] represents the amount of N.

The lower limit value of [B %]/[N %] is preferably set to be 0.10, and is more preferably set to be 0.15. The upper limit value of [B %]/[N %] is preferably set to be 2.50, and is more preferably set to be 2.00.

Further, in addition to the chemical components described above, the bake-hardenable high-strength cold-rolled steel sheet according to this embodiment may contain at least one component selected from Cu, Ni, Cr, V, W, Sn, Ca, Mg, Zr, and REM in the following range in order to improve the toughness and the ductility.

(Cu: 0.01% to 1.00%)

In order to obtain the effect of improving the toughness and the ductility with Cu, it is desirable to set the amount of Cu in the range of 0.01% to 1.00%. In the case where the steel sheet contains over 1.00% of C, there is a possibility that the toughness and the ductility deteriorate. On the other hand, in the case where the amount of Cu is stably controlled so as to be less than 0.01%, the cost required for the control significantly increases.

The lower limit of the amount of Cu is preferably set to be 0.02%, and is more preferably set to be 0.03%. The upper limit of the amount of Cu is preferably set to be 0.50%, is more preferably set to be 0.30%.

(Ni: 0.01% to 1.00%)

In order to obtain the effect of improving the toughness and the ductility with Ni, it is desirable to set the amount of Ni in the range of 0.01% to 1.00%. In the case where the steel sheet contains more than 1.00% of Ni, there is a possibility that the toughness and the ductility deteriorate. On the other hand, in the case where the amount of Ni is stably controlled so as to be less than 0.01%, the cost required for the control significantly increases.

The lower limit of the amount of Ni is preferably set to be 0.02%, and is more preferably set to be 0.03%. The upper limit of the amount of Ni is preferably set to be 0.50%, and is more preferably set to be 0.30%.

(Cr: 0.01% to 1.00%)

In order to obtain the effect of improving the toughness and the ductility with Cr, it is desirable to set the amount of Cr in the range of 0.01% to 1.00%. In the case where the steel sheet contains more than 1.00% of Cr, there is a possibility that the toughness and the ductility deteriorate. On the other hand, in the case where the amount of Cr is stably controlled so as to be less than 0.01%, the cost required for the control significantly increases.

The lower limit of the amount of Cr is preferably set to be 0.02%, and is more preferably set to be 0.03%. The upper limit of the amount of Cr is preferably set to be 0.50%, and is more preferably set to be 0.30%.

(Sn: 0.001% to 0.100%)

In order to obtain the effect of improving the toughness and the ductility with Sn, it is desirable to set the amount of Sn to be in the range of 0.001% to 0.100%. In the case where the steel sheet contains more than 0.100% of Sn, there is a possibility that the toughness and the ductility deteriorate. On the other hand, in the case where the amount of Sn is stably controlled so as to be less than 0.001%, the cost required for the control significantly increases.

The lower limit of the amount of Sn is preferably set to be 0.005%, and is more preferably set to be 0.010%. The upper limit of the amount of Sn is preferably set to be 0.050%, and is more preferably set to be 0.030%.

(V: 0.02% to 0.50%)

In order to obtain the effect of improving the toughness and the ductility with V, it is desirable to set the amount of V in the range of 0.02% to 0.50%. In the case where the steel sheet contains more than 0.50% of V, there is a possibility that the toughness and the ductility deteriorate. On the other hand, in the case where the amount of V is stably controlled so as to be less than 0.02%, the cost required for the control significantly increases.

The lower limit of the amount of V is preferably set to be 0.03%, and is more preferably set to be 0.05%. The upper limit of the amount of V is preferably set to be 0.30%, and is more preferably set to be 0.20%.

(W: 0.05% to 1.00%)

In order to obtain the effect of improving the toughness and the ductility with W, it is desirable to set the amount of W in the range of 0.05% to 1.00%. In the case where the steel sheet contains more than 1.00% of W, there is a possibility that the toughness and the ductility deteriorate. On the other hand, in the case where the amount of W is stably controlled so as to be less than 0.05%, the cost required for the control significantly increases.

The lower limit of the amount of W is preferably set to be 0.07%, is more preferably set to be 0.09%. The upper limit of the amount of W is preferably set to be 0.50%, and is more preferably set to be 0.30%.

(Ca: 0.0005% to 0.0100%)

In order to obtain the effect of improving the toughness and the ductility with Ca, it is desirable to set the amount of Ca in the range of 0.0005% to 0.0100%. In the case where the steel sheet contains more than 0.0100% of Ca, there is a possibility that the toughness and the ductility deteriorate. On the other hand, in the case where the amount of Ca is stably controlled so as to be less than 0.0005%, the cost required for the control significantly increases.

The lower limit of the amount of Ca is preferably set to be 0.0010%, and is more preferably set to be 0.0015%. The upper limit of the amount of Ca is preferably set to be 0.0080%, and is more preferably set to be 0.0050%.

(Mg: 0.0005% to 0.0100%)

In order to obtain the effect of improving the toughness and the ductility with Mg, it is desirable to set the amount of Mg in the range of 0.0005% to 0.0100%. In the case where the steel sheet contains more than 0.0100% of Mg, there is a possibility that the toughness and the ductility deteriorate. On the other hand, in the case where the amount of Mg is stably controlled so as to be less than 0.0005%, the cost required for the control significantly increases.

The lower limit of the amount of Mg is preferably set to be 0.0010%, and is more preferably set to be 0.0015%. The upper limit of the amount of Mg is preferably set to be 0.0080%, and is more preferably set to be 0.0050%.

(Zr: 0.0010% to 0.0500%)

In order to obtain the effect of improving the toughness and the ductility with Zr, it is desirable to set the amount of Zr in the range of 0.0010% to 0.0500%. In the case where the steel sheet contains more than 0.0500% of Zr, there is a possibility that the toughness and the ductility deteriorate. On the other hand, in the case where the amount of Zr is stably controlled so as to be less than 0.0010%, the cost required for the control significantly increases.

The lower limit of the amount of Zr is preferably set to be 0.0030%, and is more preferably set to be 0.0050%. The upper limit of the amount of Zr is preferably set to be 0.0400%, and is more preferably set to be 0.0300%.

(REM: 0.0010% to 0.0500%)

In order to obtain the effect of improving the toughness and the ductility with rare earth metal (REM), it is desirable to set the amount of REM in the range of 0.0010% to 0.0500%. In the case where the steel sheet contains more than 0.0500% of REM, there is a possibility that the toughness and the ductility deteriorate. On the other hand, in the case where the amount of REM is stably controlled so as to be less than 0.0010%, the cost required for the control significantly increases.

The lower limit of the amount of REM is preferably set to be 0.0015%, and is more preferably set to be 0.0020%. The upper limit of the amount of REM is preferably set to be 0.0300%, and is more preferably set to be 0.0100%.

With the bake-hardenable high-strength cold-rolled steel sheet according to this embodiment, by controlling the cold rolling reduction ratio as described later, it is possible to obtain the favorable deep-drawability and the reduced planar anisotropy. Below, a description will be made of an aggregate structure of the bake-hardenable high-strength cold-rolled steel sheet obtained by controlling the cold rolling reduction ratio as described above.

In a thin steel sheet, it has been known that the r value increases with the increase in the {111} plane parallel to a plate surface, and the r value decreases with the increase in the the {100} plane and the {110} plane parallel to the plate surface.

The bake-hardenable high-strength cold-rolled steel sheet according to this embodiment satisfies $$X(222)/\{X(110)+X(200)\} \geq 3.0 \qquad \text{Equation (1)}$$

where X(222), X(110), and X(200) represent the ratios of integrated intensity of X-ray diffraction of {222} plane, {110} plane, and {200} plane, respectively, being parallel to a plane located at a depth of ¼ plate thickness measured from the surface of the plane, thereby obtaining both the excellent average r value and Δr.

In this specification, the ratio of integrated intensity of x-ray diffraction represents a relative intensity on the basis of integrated intensity of x-ray diffraction of non-oriented standard sample. The x-ray diffraction can be measured with an energy-dispersive-type x-ray diffraction device or other general x-ray diffraction device.

It should be noted that the value of X(222)/{X(110)+X(200)} is preferably set to be 4.0 or more, and is more preferably set to be 5.0 or more.

It should be noted that coating (plating) may be applied to at least one surface of the steel sheet. The type of coating (plating) includes, for example, electro galvanizing, hot dip galvanizing, hot dipping coating (plating) with alloyed zinc, and aluminum coating (plating).

Next, a description will be made of a method of manufacturing the bake-hardenable high-strength cold-rolled steel sheet according to this embodiment. The method of manufacturing the bake-hardenable high-strength cold-rolled steel sheet according to this embodiment at least includes a hot rolling step, a coiling step, a cooling step after the coiling, a cold rolling step, a continuous annealing step, and a temper rolling step. Each of the steps will be described in detail below.

(Hot Rolling Step)

In the hot rolling step, a steel slab having the components described above is hot rolled to manufacture a hot rolled steel sheet. The heating temperature is set to be 1200° C. or more, is preferably set to be 1220° C. or more, and is more preferably set to be 1250° C. or more, at which the austenite structure before hot rolling can be sufficiently homogenized. The finishing temperature of the hot rolling is set to be not less than 900° C., which corresponds to $Ar_3$ temperature, is preferably set to be 920° C. or more, and is more preferably set to be 950° C. or more.

(Coiling Step)

In the coiling step, the hot rolled steel sheet is coiled at a temperature in the range of 700° C. to 800° C.

In the case where the coiling temperature is less than 700° C., precipitation of NbC or other carbide does not sufficiently occur during slow cooling of coil after the coiling, and hence, carbon in solid solution remains excessively in the hot rolled sheet. Thus, the aggregate structure having the favorable r value does not develop at the time of annealing after the cold rolling, causing deterioration in the deep-drawability. On the other hand, in the case where the coiling temperature exceeds 800° C., the hot roll structure coarsens, and the aggregate structure having the favorable r value does not develop at the time of annealing after cold rolling, causing deterioration in the deep-drawability.

Thus, the lower limit of the coiling temperature is preferably set to be 710° C., and is more preferably set to be 720° C. The upper limit of the coiling temperature is preferably set to be 790° C., and is more preferably set to be 780° C.

(Cooling Step After Coiling)

In the cooling step after coiling, the hot rolled steel sheet after coiling is cooled at a cooling rate of 0.01° C./sec or less, preferably at a cooling rate of 0.008° C./sec or less, and more preferably at a cooling rate of 0.006° C./sec or less. It is only necessary that, at the cooling rate, the cooling is performed such that the steel sheet temperature decreases at least from 400° C. to 250° C. This is because, in this temperature range, the solubility limit of carbon is sufficiently low, and the carbon sufficiently disperses, so that the small amount of carbon in a solid solution can precipitate as carbide. In the case where the cooling rate after coiling exceeds 0.01° C./sec, carbon in the solid solution remains excessively in the hot rolled plate. Thus, the aggregate structure having the favorable r value does not develop at the time of annealing after the cold rolling, possibly causing deterioration in the deep-drawability. The lower limit of the cooling rate after coiling may be set to be 0.001° C./sec or more, and is preferably set to be 0.002° C./sec or more by taking the productivity into consideration.

(Cold Rolling Step)

In the cold rolling step, the hot rolled steel sheet that has been coiled and subjected to acid pickling is cold rolled to manufacture a cold rolled steel sheet.

The cold rolling reduction ratio CR % is set so as to satisfy the following Equations (2) and (3) depending on the amount of Mn, P, and Mo in order to obtain the excellent deep-drawability of the average r value ≥1.4 and the reduced planar anisotropy of $|\Delta r| \leq 0.5$.

$$CR\ \% \geq 75 - 5 \times ([Mn\ \%] + 8[P\ \%] + 12[Mo\ \%]) \quad \text{Equation (2)}$$

$$CR\ \% \leq 95 - 10 \times ([Mn\ \%] + 8[P\ \%] + 12[Mo\ \%]) \quad \text{Equation (3)}$$

In this specification, CR % represents the cold rolling ratio (%), and [Mn(%)], [P(%)], and [Mo(%)] represent the mass % of Mn, P, and Mo, respectively.

Equation (2) is a condition for satisfying the average r value ≥1.4, and Equation (3) is a condition for satisfying $|\Delta r| \leq 0.5$. With a condition that satisfies both of the conditions described above, it is possible to obtain the cold rolled steel sheet having reduced planar anisotropy and the favorable deep-drawability.

It should be noted that FIG. 1 shows a relationship between the cold rolling reduction ratio CR % and components of steel sheet according to an embodiment of the present invention.

(Continuous Annealing Step)

In the continuous annealing step, the cold rolled steel sheet is subjected to continuous annealing in at a temperature in the range of 770° C. to 820° C.

As described above, the bake-hardenable high-strength cold-rolled steel sheet according to this embodiment is an ultralow carbon steel having Nb added therein (Nb-SULC), and has recrystallization temperature higher than that of the ultralow carbon steel having Ti added therein (Ti-SULC). Thus, the continuous annealing temperature is set to be in the range of 770° C. to 820° C. to complete the recrystallization.

The lower limit of the continuous annealing temperature is preferably set to be 780° C., and is more preferably set to be 790° C. The upper limit of the continuous annealing temperature is preferably set to be 810° C., and is more preferably set to be 800° C.

(Temper Rolling Step)

In the temper rolling step, the cold rolled steel sheet after the continuous annealing is subjected to the temper rolling at a rolling reduction ratio in the range of 1.0% to 1.5% to manufacture the bake-hardenable high-strength cold-rolled steel sheet.

The rolling reduction ratio in the temper rolling is set to be in the range of 1.0% to 1.5%, which is higher than the ordinary ultralow carbon steel (SULC), for the purpose of preventing the stretcher strain from occurring at the time of press forming due to the existence of C in solid solution, by utilizing the bake-hardenable cold-rolled steel sheet manufactured through the manufacturing method described above.

The lower limit of the rolling reduction ratio in the temper rolling is preferably set to be 1.05%, more preferably to 1.10%. The upper limit of the rolling reduction ratio is preferably set to be 1.4%, and is more preferably set to be 1.3%.

(Coating Step)

It should be noted that, between the continuous annealing step and the temper rolling step, it may be possible to apply a coating (plating)process to at least one side of the steel sheet. Examples of types of coating (plating) include electro galvanizing, hot dip galvanizing, hot dipping coating (plating) with alloyed zinc, and aluminum coating (plating). The conditions of coating (plating) are not specifically limited.

EXAMPLES

Next, the present invention will be described more specifically on the basis of Examples. Samples 1 to 29 were manufactured by subjecting steel slabs A to U having component ranges shown in Table 1 and Table 2 to the hot rolling, coiling, cooling after coiling, cooling after acid pickling, continuous annealing, and temper rolling under conditions shown in Table 3. Table 4 shows measurement results of the samples 1 to 29 in terms of tensile strength (MPa), BH value (MPa), average r value, |Δr|, and YP-El (%) after aging.

The BH(%) represents the bake hardenability, and the BH amount was measured such that: the amount of predeformation in the BH test was 2%; aging corresponding to the coating and baking process was performed under the conditions of a temperature of 170° C. for 20 minutes; and evaluation was made with the upper yield point at the time of re-tension. The YP-El (%) after aging is an index for evaluation of cold aging resistance, and represents the elongation at a yield point when a thermal treatment was applied for one hour at a temperature of 100° C., and then tension test was performed.

No. 5 test samples specified in JIS Z 2201 were cut out from the cold rolled steel sheet in an L direction (rolling direction), D direction (at an angle of 45° relative to the rolling direction), and C direction (at an angle of 90° relative to the rolling direction); the r values ($r_L$, $r_D$, $r_C$) were obtained for each of the directions in accordance with the requirements under JIS Z 2254; and the average r value and the planar anisotropy (Δr value) were obtained in accordance with Equations (4) and (5). It should be noted that the applied plastic strain was 15%, which is in the range of specified uniform elongation.

$$\text{Average } r \text{ value}=(r_L+2\times r_D+r_C)/4 \qquad \text{Equation (4)}$$

$$\Delta r \text{ value}=(r_L\times 2\times r_D+r_C)/2 \qquad \text{Equation (5)}$$

With the energy-dispersive-type x-ray diffraction device, measurement was made on X(222), X(110), and X(200) representing the ratios of integrated intensity of X-ray diffraction of {222} plane, {110} plane, and {200} plane, respectively, being parallel to a plane located at a depth of ¼ plate thickness measured from the surface of the steel sheet, thereby obtaining a value (T value) of T=X(222)/{X(110)+X(200)}.

[Table 1]

[Table 2]

[Table 3]

[Table 4]

As can be seen from Table 1 to Table 4, it is confirmed that, with Comparative Examples that do not satisfy the conditions of the present invention, any of the tensile strength, the BH, the average r value, the |Δr| value, and the YP-El (%) after cold aging deteriorated. On the other hand, with Examples that satisfy the conditions of the present invention, all of the tensile strength, the BH, the average r value, the |Δr| value, and the YP-El (%) after cold aging were favorable. From the examples described above, the effect of the present invention was confirmed.

INDUSTRIAL APPLICABILITY

According to the present invention, it is possible to provide the bake-hardenable high-strength cold-rolled steel sheet having excellent bake hardenability and cold aging resistance, reduced planar anisotropy, and favorable deep-drawability, and a method of manufacturing the bake-hardenable high-strength cold-rolled steel sheet.

TABLE 1

| Steel | C | Si | Mn | P | S | Al | N | Nb | Mo | Ti | B |
|---|---|---|---|---|---|---|---|---|---|---|---|
| | mass % | | | | | | | | | | |
| A | 0.0019 | 0.01 | 0.39 | 0.047 | 0.008 | 0.062 | 0.0021 | 0.006 | 0.036 | | |
| B | 0.0012 | 0.02 | 0.45 | 0.056 | 0.006 | 0.051 | 0.0033 | 0.003 | 0.048 | | |
| C | 0.0038 | 0.01 | 0.60 | 0.022 | 0.003 | 0.034 | 0.0018 | 0.014 | 0.029 | | |
| D | 0.0014 | 0.04 | 0.37 | 0.055 | 0.005 | 0.048 | 0.0025 | 0.003 | 0.015 | | |
| E | 0.0022 | 0.01 | 0.12 | 0.066 | 0.004 | 0.054 | 0.0041 | 0.007 | 0.039 | | |
| F | 0.0035 | 0.02 | 0.78 | 0.027 | 0.005 | 0.044 | 0.0011 | 0.018 | 0.006 | 0.001 | 0.0006 |
| G | 0.0033 | 0.01 | 0.43 | 0.050 | 0.007 | 0.067 | 0.0024 | 0.005 | 0.026 | 0.015 | 0.0003 |
| H | 0.0016 | 0.02 | 0.35 | 0.042 | 0.002 | 0.019 | 0.0013 | 0.008 | 0.034 | | |
| I | 0.0035 | 0.01 | 0.38 | 0.058 | 0.004 | 0.036 | 0.0010 | 0.009 | 0.005 | 0.010 | 0.0025 |
| J | 0.0031 | 0.04 | 0.76 | 0.018 | 0.006 | 0.028 | 0.0023 | 0.015 | 0.012 | 0.009 | 0.0005 |
| K | 0.0018 | 0.02 | 0.35 | 0.035 | 0.006 | 0.053 | 0.0025 | 0.005 | 0.028 | | |
| L | 0.0028 | 0.03 | 0.38 | 0.042 | 0.005 | 0.048 | 0.0021 | 0.006 | 0.023 | 0.013 | 0.0004 |
| M | 0.0008 | 0.01 | 0.57 | 0.062 | 0.005 | 0.060 | 0.0017 | 0.005 | 0.030 | | |
| N | 0.0045 | 0.02 | 0.24 | 0.063 | 0.003 | 0.055 | 0.0022 | 0.009 | 0.042 | 0.010 | 0.0002 |
| O | 0.0023 | 0.01 | 0.40 | 0.049 | 0.008 | 0.046 | 0.0018 | 0.013 | 0.038 | 0.008 | |
| P | 0.0018 | 0.01 | 0.08 | 0.007 | 0.005 | 0.051 | 0.0025 | 0.007 | 0.031 | | |
| Q | 0.0021 | 0.02 | 0.35 | 0.055 | 0.002 | 0.040 | 0.0034 | 0.008 | 0.003 | | |
| R | 0.0027 | 0.06 | 0.78 | 0.016 | 0.006 | 0.062 | 0.0023 | 0.005 | 0.038 | | |
| S | 0.0035 | 0.02 | 0.10 | 0.072 | 0.008 | 0.034 | 0.0017 | 0.002 | 0.026 | 0.014 | 0.0003 |
| T | 0.0023 | 0.04 | 0.75 | 0.062 | 0.006 | 0.049 | 0.0020 | 0.006 | 0.045 | | |
| U | 0.0032 | 0.01 | 0.20 | 0.028 | 0.005 | 0.058 | 0.0019 | 0.010 | 0.023 | 0.011 | 0.0003 |

TABLE 2

| Steel | Cu | Ni | Cr | Sn | V | W | Ca | Mg | Zr | REM | Ti' | C in solid solution | Mn/P | Nb/Ti | B/N |
|---|---|---|---|---|---|---|---|---|---|---|---|---|---|---|---|
| | mass % | | | | | | | | | | | | | | |
| A | | | | | | | | | | | | 0.0011 | 8.3 | | |
| B | | | | | | | | | | | | 0.0008 | 8.0 | | |
| C | | | | | | | | | | | | 0.0020 | 27.3 | | |
| D | | | | | | | | | | | | 0.0010 | 6.7 | | |
| E | | | | | | | | | | | | 0.0013 | 1.8 | | |

TABLE 2-continued

| Steel | Cu | Ni | Cr | Sn | V | W | Ca | Mg | Zr | REM | Ti' | C in solid solution | Mn/P | Nb/Ti | B/N |
|---|---|---|---|---|---|---|---|---|---|---|---|---|---|---|---|
| | mass % | | | | | | | | | | | | | | |
| F | | | | | | | | | | | (0.003) | 0.0012 | 28.9 | 36.00 | 0.55 |
| G | | | | | | | | | | | 0.007 | 0.0010 | 8.6 | 0.30 | 0.13 |
| H | 0.10 | 0.10 | 0.20 | 0.050 | | | | | | | | 0.0006 | 8.3 | | |
| I | 0.20 | 0.10 | 0.30 | 0.080 | | | | | | | 0.007 | 0.0007 | 6.6 | 0.90 | 2.50 |
| J | | | | | | | | | | | 0.001 | 0.0009 | 42.2 | 1.70 | 0.22 |
| K | | | | | 0.04 | 0.09 | 0.0025 | 0.0028 | 0.02 | 0.0045 | | 0.0012 | 10.0 | | |
| L | | | | | 0.05 | 0.10 | 0.0031 | 0.0035 | 0.01 | 0.0036 | 0.006 | 0.0006 | 9.0 | 0.50 | 0.19 |
| M | | | | | | | | | | | | 0.0002 | 9.2 | | |
| N | | | | | | | | | | | 0.002 | 0.0027 | 3.8 | 0.90 | 0.09 |
| O | | | | | | | | | | | 0.002 | 0.0002 | 8.2 | 1.60 | |
| P | | | | | | | | | | | | 0.0009 | 11.4 | | |
| Q | | | | | | | | | | | | 0.0011 | 6.4 | | |
| R | | | | | | | | | | | | 0.0021 | 48.8 | | |
| S | | | | | | | | | | | 0.008 | 0.0012 | 1.4 | 0.10 | 0.18 |
| T | 0.30 | | | 0.100 | | | | | | | | 0.0015 | 12.1 | | |
| U | | | | | | | | | | | | 0.0008 | 7.1 | 0.90 | 0.20 |

TABLE 3

| Sample | Steel | Heating temperature in hot rolling (° C.) | Finishing temperature in hot rolling (° C.) | Coiling temperature in hot rolling (° C.) | Cooling rate from 400° C. to 250° C. (° C./sec) | Cold rolling reduction ratio (%) | Value of Equation (2) | Value of Equation (3) | Annealing temperature (° C.) | Temper rolling reduction ratio (%) | Value of Equation (1) (T value) |
|---|---|---|---|---|---|---|---|---|---|---|---|
| 1 | A | 1250 | 950 | 750 | 0.005 | 75 | 69 | 83 | 800 | 1.2 | 9.3 |
| 2 | B | 1230 | 920 | 720 | 0.002 | 75 | 68 | 80 | 820 | 1.5 | 7.2 |
| 3 | C | 1240 | 930 | 770 | 0.003 | 80 | 69 | 84 | 770 | 1.3 | 11.5 |
| 4 | D | 1210 | 910 | 740 | 0.009 | 82 | 70 | 85 | 790 | 1.2 | 10.8 |
| 5 | E | 1260 | 960 | 790 | 0.006 | 75 | 69 | 84 | 810 | 1.0 | 6.5 |
| 6 | F | 1220 | 940 | 720 | 0.003 | 82 | 70 | 84 | 820 | 1.4 | 14.9 |
| 7 | G | 1250 | 960 | 750 | 0.003 | 70 | 69 | 84 | 800 | 1.2 | 3.6 |
| 8 | H | 1230 | 930 | 710 | 0.005 | 75 | 70 | 84 | 790 | 1.3 | 8.2 |
| 9 | I | 1210 | 950 | 760 | 0.004 | 82 | 70 | 86 | 810 | 1.2 | 15.2 |
| 10 | J | 1250 | 940 | 730 | 0.002 | 84 | 70 | 85 | 800 | 1.4 | 14.7 |
| 11 | K | 1260 | 960 | 740 | 0.004 | 73 | 70 | 85 | 810 | 1.1 | 9.5 |
| 12 | L | 1240 | 950 | 760 | 0.003 | 74 | 70 | 85 | 820 | 1.2 | 4.1 |
| 13 | M | 1260 | 930 | 730 | 0.006 | 70 | 68 | 81 | 790 | 1.2 | 3.2 |
| 14 | N | 1240 | 950 | 770 | 0.004 | 80 | 69 | 83 | 810 | 1.0 | 6.7 |
| 15 | O | 1250 | 960 | 720 | 0.005 | 82 | 69 | 83 | 790 | 1.4 | 5.6 |
| 16 | P | 1230 | 920 | 740 | 0.003 | 80 | 72 | 90 | 780 | 1.3 | 7.2 |
| 17 | Q | 1240 | 980 | 750 | 0.006 | 82 | 71 | 87 | 800 | 1.2 | 11.3 |
| 18 | R | 1210 | 930 | 710 | 0.007 | 75 | 68 | 81 | 810 | 1.5 | 2.8 |
| 19 | S | 1230 | 910 | 790 | 0.009 | 82 | 70 | 85 | 790 | 1.0 | 2.2 |
| 20 | T | 1280 | 960 | 720 | 0.007 | 80 | 66 | 77 | 800 | 1.3 | 2.6 |
| 21 | U | 1260 | 940 | 740 | 0.008 | 70 | 72 | 88 | 810 | 1.4 | 2.1 |
| 22 | A | 1180 | 870 | 750 | 0.005 | 75 | 69 | 83 | 750 | 1.2 | 2.7 |
| 23 | A | 1270 | 980 | 820 | 0.004 | 73 | 69 | 83 | 800 | 1.7 | 2.3 |
| 24 | A | 1230 | 910 | 650 | 0.009 | 74 | 69 | 83 | 770 | 0.8 | 2.2 |
| 25 | A | 1240 | 930 | 700 | 0.100 | 76 | 69 | 83 | 830 | 1.2 | 2.8 |
| 26 | G | 1170 | 980 | 830 | 0.005 | 72 | 69 | 84 | 810 | 1.2 | 2.2 |
| 27 | G | 1230 | 880 | 710 | 0.008 | 70 | 69 | 84 | 760 | 1.9 | 2.5 |
| 28 | G | 1270 | 910 | 640 | 0.006 | 71 | 69 | 84 | 840 | 1.1 | 2.3 |
| 29 | G | 1260 | 930 | 730 | 0.090 | 74 | 69 | 84 | 770 | 0.6 | 2.8 |

TABLE 4

| Sample | Steel | Tensile strength (MPa) | BH (MPa) | Average r value | \|Δr\| | YP-El After aging (%) |
|---|---|---|---|---|---|---|
| 1 | A | 363 | 36 | 1.7 | 0.4 | 0 |
| 2 | B | 375 | 33 | 1.6 | 0.3 | 0 |
| 3 | C | 358 | 52 | 1.8 | 0.5 | 0.1 |
| 4 | D | 381 | 35 | 1.8 | 0.5 | 0 |
| 5 | E | 346 | 41 | 1.6 | 0.3 | 0 |
| 6 | F | 357 | 44 | 1.9 | 0.5 | 0 |
| 7 | G | 370 | 39 | 1.5 | 0.4 | 0 |

TABLE 4-continued

| Sample | Steel | Tensile strength (MPa) | BH (MPa) | Average r value | \|Δr\| | YP-El After aging (%) |
|---|---|---|---|---|---|---|
| 8 | H | 354 | 32 | 1.7 | 0.3 | 0 |
| 9 | I | 360 | 58 | 1.9 | 0.5 | 0.2 |
| 10 | J | 342 | 42 | 1.8 | 0.5 | 0 |
| 11 | K | 387 | 34 | 1.7 | 0.3 | 0 |
| 12 | L | 390 | 36 | 1.6 | 0.3 | 0 |
| 13 | M | 384 | 18 | 1.5 | 0.2 | 0 |
| 14 | N | 361 | 72 | 1.8 | 0.4 | 1.5 |

TABLE 4-continued

| Sample | Steel | Tensile strength (MPa) | BH (MPa) | Average r value | \|Δr\| | YP-El After aging (%) |
|---|---|---|---|---|---|---|
| 15 | O | 352 | 24 | 1.8 | 0.5 | 0 |
| 16 | P | 284 | 35 | 1.8 | 0.4 | 0 |
| 17 | Q | 350 | 38 | 1.9 | 0.5 | 0.9 |
| 18 | R | 388 | 42 | 1.7 | 0.6 | 0 |
| 19 | S | 453 | 36 | 1.2 | 0.3 | 0 |
| 20 | T | 388 | 42 | 1.8 | 0.7 | 0 |
| 21 | U | 348 | 36 | 1.3 | 0.3 | 0 |
| 22 | A | 342 | 31 | 1.3 | 0.5 | 0 |
| 23 | A | 358 | 32 | 1.2 | 0.6 | 0 |
| 24 | A | 375 | 39 | 1.1 | 0.7 | 0.3 |
| 25 | A | 366 | 38 | 1.3 | 0.5 | 0 |
| 26 | G | 367 | 38 | 1.2 | 0.6 | 0 |
| 27 | G | 375 | 34 | 1.3 | 0.5 | 0 |
| 28 | G | 370 | 39 | 1.2 | 0.6 | 0.4 |
| 29 | G | 370 | 39 | 1.3 | 0.5 | 0 |

We claim:

1. A bake-hardenable high-strength cold-rolled steel sheet having excellent bake hardenability, cold aging resistance, and deep-drawability, which is represented by an average r value of not less than 1.4, and reduced planar anisotropy represented by $|\Delta r| \leq 0.5$, with chemical components consisting of, in % by mass:

C: 0.0016% to 0.0040%,
Si: 0.005% to 0.05%,
Mn: 0.1% to 0.45%,
P: 0.01% to 0.07%,
S: 0.001% to 0.008%,
Al: 0.01% to 0.08%,
N: 0.0010% to 0.0050%,
Nb: 0.002% to 0.020%,
Mo: 0.005% to 0.050%,
Cu: 0% to 1.00%,
Ni: 0% to 1.00%,
Cr: 0% to 1.00%,
Sn: 0% to 0.100%,
V: 0% to 0.50%,
W: 0% to 1.00%,
Ca: 0% to 0.0100%,
Mg: 0% to 0.0100%,
Zr: 0% to 0.0500%, and
REM: 0% to 0.0500%, a value of [Mn %]/[P %] being in a range of 1.6 to 45, where [Mn %] is an amount of Mn and [P %] is an amount of P, an amount of C in solid solution obtained from [C %]−(12/93)×[Nb %] being in a range of 0.0005% to 0.0025%, where [C %] is an amount of C and [Nb %] is an amount of Nb, with a balance consisting of Fe and inevitable impurities, wherein the bake-hardenable high-strength cold-rolled steel sheet satisfies following Equation (1), where X(222), X(110), and X(200) represent ratios of integrated intensity of X-ray diffraction of {222} plane, {110} plane, and {200} plane, respectively, being parallel to a plane located at a depth of ¼ plate thickness measured from a surface of the steel sheet, and the bake-hardenable high-strength cold-rolled steel sheet has tensile strength in a range of 300 MPa to 450 MPa, $$14.9 \geq X(222)/\{X(110)+X(200)\} \geq 3.0 \text{ Equation} \quad (1).$$

2. The bake-hardenable high-strength cold-rolled steel sheet as claimed in claim 1, wherein the chemical components include, by mass, at least one chemical component selected from:

Cu: 0.01% to 1.00%,
Ni: 0.01% to 1.00%,
Cr: 0.01% to 1.00%,
Sn: 0.001% to 0.100%,
V: 0.02% to 0.50%,
W: 0.05% to 1.00%,
Ca: 0.0005% to 0.0100%,
Mg: 0.0005% to 0.0100%,
Zr: 0.0010% to 0.0500%, and
REM: 0.0010% to 0.0500%.

3. The bake-hardenable high-strength cold-rolled steel sheet as claimed in claim 1 or 2, wherein a coated layer is provided on at least one surface.

4. A method of manufacturing a bake-hardenable high-strength cold-rolled steel sheet, including:

hot rolling a slab containing chemical components as claimed in claim 1 or claim 2 at a heating temperature of not less than 1200° C. and at a finishing temperature of not less than 900° C. to obtain a hot rolled steel sheet;

coiling the hot rolled steel sheet at a temperature in the range of 700° C. to 800° C.;

cooling the hot rolled steel sheet that has been coiled at a cooling rate of not more than 0.01° C./sec so as to decrease the temperature at least from 400° C. to 250° C.;

performing cold rolling under a condition that a cold rolling reduction ratio CR % at the time of cold rolling after acid pickling satisfies the following Equations (2) and (3), where [Mn %] is an amount of Mn, [P %] is an amount of P, and [Mo %] is an amount of Mo;

performing continuous annealing in a temperature range of 770° C. to 820° C.; and performing temper rolling in a rolling reduction ratio of 1.0% to 1.5%, $$CR\ \% \geq 75-5\times([Mn\ \%]+8[P\ \%]+12[Mo\ \%]) \quad \text{Equation (2)}$$

$$CR\ \% \leq 95-10\times([Mn\ \%]+8[P\ \%]+12[Mo\ \%]) \quad \text{Equation(3).}$$

5. The method of manufacturing a bake-hardenable high-strength cold-rolled steel sheet as claimed in claim 4, further including providing a coated layer on at least one surface before performing the temper rolling.

6. The bake-hardenable high-strength cold-rolled steel sheet as claimed in claim 1, wherein the amount of Mn is not more than 0.40% by mass.

* * * * *